US009556715B2

(12) United States Patent
Reid et al.

(10) Patent No.: US 9,556,715 B2
(45) Date of Patent: Jan. 31, 2017

(54) GAS PRODUCTION USING A PUMP AND DIP TUBE

(75) Inventors: Leslie C. Reid, Coweta, OK (US); Edward C. Kanady, Tulsa, OK (US)

(73) Assignee: BAKER HUGHES INCORPORATED, Houston, TX (US)

( * ) Notice: Subject to any disclaimer, the term of this patent is extended or adjusted under 35 U.S.C. 154(b) by 489 days.

(21) Appl. No.: 13/033,382

(22) Filed: Feb. 23, 2011

(65) Prior Publication Data

US 2012/0211238 A1 Aug. 23, 2012

(51) Int. Cl.
*E21B 43/00* (2006.01)
*E21B 43/12* (2006.01)

(52) U.S. Cl.
CPC ..... *E21B 43/12* (2013.01); *E21B 43/121* (2013.01)

(58) Field of Classification Search
USPC ..... 166/50, 68, 105, 105.5, 250.07, 166/250.15, 265, 267, 369, 370, 371; 417/118, 120
See application file for complete search history.

(56) References Cited

U.S. PATENT DOCUMENTS

| | | | | |
|---|---|---|---|---|
| 5,154,588 | A * | 10/1992 | Freet et al. | 417/423.3 |
| 5,271,725 | A | 12/1993 | Freet et al. | |
| 5,348,094 | A * | 9/1994 | Cholet et al. | 166/371 |
| 6,322,616 | B1 | 11/2001 | Kennedy et al. | |
| 6,325,152 | B1 * | 12/2001 | Kelley et al. | 166/370 |
| 6,904,981 | B2 | 6/2005 | Riet | |
| 7,604,464 | B2 | 10/2009 | Williams | |
| 7,828,059 | B2 | 11/2010 | Reid et al. | |
| 2006/0225888 | A1 * | 10/2006 | Reitz | 166/370 |
| 2010/0200224 | A1 * | 8/2010 | Toguem Nguete et al. | 166/250.15 |
| 2011/0214880 | A1 * | 9/2011 | Rogers | E21B 43/00 166/372 |

* cited by examiner

*Primary Examiner* — Taras P Bemko
(74) *Attorney, Agent, or Firm* — Mossman Kumar & Tyler PC

(57) ABSTRACT

A pressure control system varies a parameter of a gas flowing out of the well to artificially generate a pressure value at a fluid mover. The fluid mover receives fluid from a conduit such as a dip tube positioned in the well. The system may also include a flow control device controlling a gas flow out of the well and a controller controlling the flow control device using information relating to at least one wellbore parameter.

16 Claims, 1 Drawing Sheet

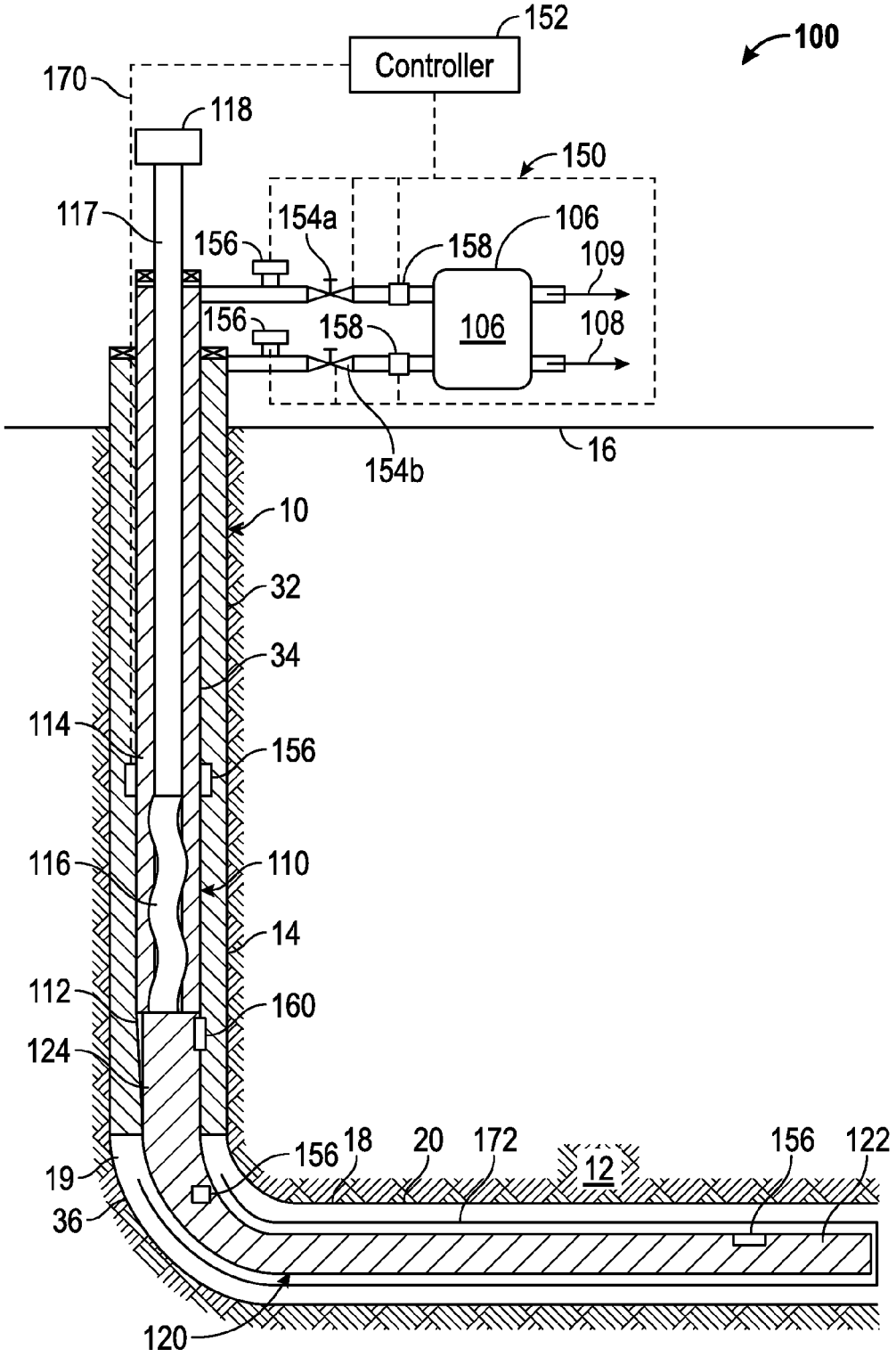
152
Controller
100
170
118
150
117
154a
106
156
158
109
156
158
106
108
154b
16
10
32
34
114
156
116
110
14
112
160
124
156
18
20
172
12
156
122
19
36
120

GAS PRODUCTION USING A PUMP AND DIP TUBE

BACKGROUND OF THE DISCLOSURE

1. Field of the Disclosure

The disclosure herein relates generally to the methods and devices for controlling gas production.

2. Background of the Art

Hydrocarbon gas is usually recovered using a well drilled into a formation having a gas reservoir. A gas well may have a complex geometry that includes vertical sections and deviated sections, at least some of which intersect a gas-producing zone, or "pay zone." Water is often produced along with the gas in a pay zone. Because the hydrostatic pressure associated with produced water can impair the rate of gas production, it is usually desirable to control the amount of water residing in a pay zone or other section of a well. However, the borehole of the well may have geometry or trajectory that prevents a fluid mover, such as a pump, from being located in the well to efficiently remove accumulated water.

The present disclosure is directed to methods, devices, and system for removing water from a section of the well using a remotely situated fluid mover.

SUMMARY OF THE DISCLOSURE

In aspects, the present disclosure provides a system for controlling pressure in a gas producing well. The system may vary a parameter of a gas flowing out of the well to artificially generate a suction head at a fluid mover that receives fluid from a dip tube or other fluid conduit positioned in the well.

An illustrative system may include a fluid mover positioned in the well and a conduit coupled to the fluid mover. The conduit conveys a liquid to the fluid mover from a selection location in the well. The system may also include a flow control device controlling a gas flow out of the well and a controller controlling the flow control device by using information relating to at least one wellbore parameter.

Examples of the more important features of the disclosure have been summarized rather broadly in order that the detailed description thereof that follows may be better understood and in order that the contributions they represent to the art may be appreciated. There are, of course, additional features of the disclosure that will be described hereinafter and which will form the subject of the claims appended hereto.

BRIEF DESCRIPTION OF THE DRAWINGS

For a detailed understanding of the present disclosure, reference should be made to the following detailed description of the embodiments, taken in conjunction with the accompanying drawings, in which like elements have been given like numerals, wherein:

The FIGURE schematically illustrates an elevation view of a pressure control system made in accordance with one embodiment of the present disclosure.

DETAILED DESCRIPTION OF THE DISCLOSURE

Referring initially to the FIGURE, there is schematically shown a well for producing hydrocarbons from a subsurface formation. While aspects of the present disclosure may be used in numerous situations, merely for brevity, embodiments of the present disclosure will be discussed in the context of gas production. In the FIGURE, a well 10 is shown intersecting a shale formation 12. The well 10 has a substantially vertical leg 14 that extends downward from the surface 16 to a point at or near a pay zone 18. The well 10 has a deviated or horizontal leg 20 that extends into the pay zone 18. Gas flowing out of the pay zone 18 flows via a well annulus 19 to the surface 16. The annulus 19 is generally the space between an outer surface of a wellbore tubular (e.g., tubing 32) and an adjacent wall (e.g, borehole wall 36). The formation 12 can also produce water that flows into the well 10. In certain situations, the water may accumulate to a point where the hydrostatic pressure applied by the water impairs the flow of gas from the formation 12 into the horizontal leg 20.

In aspects, the present disclosure provides a gas production system 100 that optimizes gas flow from the pay zone 18 by controlling water accumulation in the well 10. As will be described in greater detail below, the system 100 varies gas flow to artificially generate a suction head at a fluid mover 110, e.g., a pump. By "artificially" generated, it is meant that the suction head at the fluid mover 110 is attributed at least partly to some applied force beyond the hydrostatic head that is naturally available due to a liquid height or level in the well 10.

The well 10 may include a casing 32 for receiving gas from the pay zone 18. The gas flows primarily along the annulus 19 around the tubing 34 toward the surface 16. The well 10 may also include a tubing 34 for conveying liquids from the well 10 toward the surface 16. The liquids may include water, which as used herein refers to liquids that have a water component (e.g., brine, salt water), and liquid hydrocarbons. Merely for convenience, water will be used as the illustrative liquid. The produced gas may include entrained liquids and the produced water may include entrained gas. Therefore, at the surface, the system 100 may include a separator 106 that receives the produced fluids from the well 10 and outputs a substantially liquid stream 108 and a substantially gas stream 109.

The fluid mover 110 may be connected to a fluid conduit 120 to remove water from a location along the horizontal section 20 of the well 10. The fluid conduit 120 may be formed as a dip tube that has a first end 122 positioned in the horizontal leg 20 and a second end 124 in fluid communication with an inlet 112 of the fluid mover 110. The fluid mover 110 has an outlet 114 in fluid communication with the tubing 34. During operation, the fluid conduit 120 channels water into the inlet 112, and the fluid mover 110 flows the water up through the tubing 34 to the surface. Illustrative fluid movers include, but are not limited to, electric submersible pumps, positive displacement pumps, centrifugal pumps, jet pumps, rod driven progressive cavity pumps, jet pumps, hydraulic pumps, reciprocating pumps, and other devices that add energy to a fluid to cause fluid movement. FIG. 1 illustrates a rod-driven progressing cavity pump 116 driven by a rod 117 rotated by a surface drive unit 118. Merely for convenience, the terms "fluid mover" and "pump" and the terms "fluid conduit" and "dip tube" are used interchangeably.

In some well configurations, the geometry of the borehole may not accommodate the pump 110 being positioned in horizontal leg 20 to directly receive accumulated water. Therefore, the pump 110 is set as low as possible in the vertical section 14 and the dip tube 120 is extended out into the horizontal leg 20 to reach the accumulated water. In some embodiments, the inlet of the dip tube 120 is positioned in a concave portion of the wellbore where such water collects. The system 100 may use horizontal wellbore gas avoiding techniques to separate the gas and the liquid in the well. These separate techniques generally rely on the density difference between gas and the liquid for phase separation. For example, an inverted shroud 172 may be used. The inverted shroud 172 may be a tubular member with a closed end at the end 122 of the dip tube 120. Also, the dip tube 120 may include weighted intake ports (not shown). These intake ports orient themselves to the bottom of the bore. For example, the ports may rotate to a low point to better receive the high-density liquid than the lower density gas.

To ensure a continuous flow of water into the pump inlet 112, the system 100 may include a pressure control system 150 that maintains a pressure on the water in the annulus 19. This maintained pressure forces the water in the annulus 19 to flow through a bore of the fluid conduit 120 and into the pump inlet 112. In aspects, the pressure control system 150 provides a pressure at the pump inlet 112 that is near or greater than the minimum net positive suction head pressure for the pump 110.

In one embodiment, the pressure control system 150 controls the pressure in the annulus 19 (or casing pressure) using a controller 152. The controller 152 may include an information processor (not shown), a data storage medium (not shown), and other suitable circuitry for storing and implementing computer programs and instructions. The controller 152 may be programmed to cause or maintain a desired casing pressure by controlling gas flowing out of the well 10. In one arrangement, casing pressure is controlled using flow control devices 154*a,b* that control one or more flow parameters of the gas and/or water flowing out of the well 10 and sensors 156-160 for measuring one or more parameters of interest.

The flow control devices 154*a,b* may include one or more valves, chokes, or adjustable flow restrictions that are configured to control a fluid flow rate. The control may encompass increasing, decreasing, modulating, and/or maintaining a selected flow parameter. The flow control device 154*b* controlling gas flow out of the casing 32 may be actuated as needed by the controller 152 to vary a pressure of the gas in the casing 32.

The sensors 156-160 provide information for controlling the flow control devices 154*a,b* and/or other equipment such as the pump 110. The information may be "raw" data, processed data, inferential, indirect measurements, direct measurements, analog, digital, etc. In one embodiment, the sensors may include surface sensors 156 that measure pressure of the gas and water streams. Additionally, flow meters 158 may measure the flow rates of the gas and water streams. The sensors may also be strategically distributed in the well 10. For example, one or more pressure sensors 156 may be positioned in the fluid conduit 120, in the annulus 19, at the pump 110, etc. In some embodiments, level sensors 160 may be used to detect the level of the water column in the annulus 19 and/or the bore of the fluid conduit 120. The information from the sensors may be conveyed to the surface via a suitable signal carrier 170, such as metal wire, optical cables, etc. or wirelessly (e.g., RF signal).

In one illustrative operating mode, the pressure control system 150 may be programmed to use gas pressure in the casing 32 to keep the pump 110 primed with a liquid, e.g., water, crude oil, condensate, liquid hydrocarbons and/or mixtures thereof. This operating mode uses the fact that the gas in the annulus 19, the liquid in the annulus 19, and the liquid in the dip tube 120 are all in pressure communication. Thus, a change in pressure of the gas in the annulus 19 may be transmitted to the liquid in the dip tube 120. In some situations, the pressure control system 150 may be configured to control pressure in the casing 34 to a minimum level sufficient to insure the dip tube 120 has enough natural drive to lift the water up to the pump inlet 112. In some embodiments, the casing pressure may be controlled based on the minimum net positive suction head (NPSHR) required for the pump 110. NPSHR may be calculated by: NPSHR=Head+(tubing losses)+(safety factor).

During operation, the pressure control system 150 may receive information from one or more sensors 156-160. Using pre-programmed instructions, the controller 152 may use this information to, if needed, alter one or more pump 110 or drive unit 118 operating parameters (e.g., RDPCP speed, direction of rotation) and/or valve position to achieve or obtain a desired operating condition. Illustrative operating conditions include, but are not limited to, maintaining a liquid contact between the fluid and the fluid mover, maintaining a desired pressure at the pump inlet 112, etc. For example, if the pressure at the pump inlet 112 or pump flow rate drops below a specified value, the controller 152 may choke/increase gas flowing out of the well 10 using the flow control device 154*b*. Choking the gas flow increases casing pressure and forces water to flow into and up the dip tube 120. The casing pressure is increased until the water reaches the pump inlet 112 and is maintained at a desired value (e.g., minimum NPSHR to the pump). In another example, the controller 152 may receive temperature information from the pump 110 that indicates that the pump is hot due to gas buildup in the dip tube 120. In such an instance, the controller 152 may also restrict gas outflow to force water through the dip tube 120. In another instance, the controller 154 may decrease a pressure applied to the liquid by increasing a rate of gas flow out of the well. The controller 152 may also control one or more operating parameters of the pump 110 (e.g., pump speed) and/or drive unit 118. Thus, the controller may increase or decrease a pressure applied to the liquid in the dip tube 120.

It should be understood that the arrangement shown in the FIGURE is merely one embodiment of the present disclosure. Other embodiments may omit certain elements or include additional features. For example, the system 100 may include a subsurface valve above or below the pump 110 to release gas that may have accumulated during operation. Also, in certain arrangements, the pump 110 may be continuously operated to control reservoir pressure whereas in other arrangements the pump 110 may be operated only when needed to achieve a desired production flow rate or reservoir pressure.

Further, it should be appreciated that the controller 152 may be programmed with any number or types of wellbore parameters for use as a reference for controlling one or more aspects of the system 100. Illustrative parameters include, but are not limited to, environmental parameter such as a reservoir pressure, pressure differentials in the well, a pump flow rate, and a gas flow rate, water flow rate, casing pressure, tubing pressure, downhole pressure at the pump, pressure at the dip tube inlet and equipment parameters such as pump motor amps, motor torque, pump speed, pump temperature, motor temperature, etc. Also, the operating parameter may be a set point, a range, a minimum, a maximum, a threshold, etc.

Additionally, the controller 152 may use optimization routines to identify optimal operating set-points for one or more components of the system 100. For example, the controller 152 may sweep over a range of settings for the flow control devices 154*a,b* in order to locate a given setting that maximizes gas production. Similar techniques may be used to locate an optimal setting for the pump 110 and the drive unit 118.

While the foregoing disclosure is directed to the one mode embodiments of the disclosure, various modifications will be apparent to those skilled in the art. It is intended that all variations within the scope of the appended claims be embraced by the foregoing disclosure.

The invention claimed is:

1. A system for controlling pressure in a well having a juncture between a substantially vertical leg and a deviated leg, the well intersecting a gas producing zone, the system comprising:

a fluid mover positioned in the substantially vertical leg of the well and uphole of the juncture;

a conduit coupled to the fluid mover and having an inlet positioned in the deviated leg of the well and at an elevation below the fluid mover, the conduit configured to convey at least a liquid from the deviated leg of the well to the substantially vertical leg of the well to the fluid mover;

a tubing conveying the liquid from the fluid mover to the surface;

an annulus in the well conveying the gas from the gas producing zone to the surface, the annulus having a first section formed between the conduit and the wellbore wall and a second section formed between the tubing and the wellbore wall;

a flow control device receiving a gas flow from the second section of the annulus and controlling the gas out of the annulus of the well, the gas being in pressure communication with the liquid; and a controller controlling the flow control device using information relating to at least one wellbore parameter, wherein the controller is configured to increase a pressure applied to the liquid in the conduit by controlling the rate of gas flowing out of the well using the flow control device, wherein the gas in the annulus, a liquid in the annulus, and the liquid in the conduit are in pressure communication with one another.

2. The system of claim 1, further comprising at least one pressure sensor positioned in the well, wherein the controller uses information from the at least one pressure sensor.

3. The system of claim 2, wherein the at least one pressure sensor includes a first pressure sensor at the fluid mover and a second pressure sensor at a selected location along the conduit.

4. The system of claim 2, wherein the information includes at least a pressure differential in the well.

5. The system of claim 1, wherein the controller is programmed to control the flow control device to maintain a liquid contact between the fluid and the fluid mover.

6. The system of claim 5, wherein the controller is programmed to generate a predetermined net suction pressure head at the fluid mover.

7. The system of claim 1, wherein the controller is further configured to control at least one operating parameter relating to the flow control device.

8. The system of claim 1, wherein the fluid mover is configured to remove a liquid produced from the well to at least one of: (i) control reservoir pressure, (ii) achieve a desired production flow rate of a gas.

9. A method for controlling pressure in a well having a juncture between a substantially vertical leg and a deviated leg, the well intersecting a gas producing zone, the system comprising:

positioning a fluid mover in the substantially vertical leg of the well and uphole of the juncture;

coupling a conduit to the fluid mover, the conduit having an inlet positioned in the deviated leg of the well and at an elevation below the fluid mover, the conduit configured to convey at least a liquid from the deviated leg of the well to the substantially vertical leg of the well to the fluid mover;

conveying a gas from the gas producing zone to a surface location using an annulus in the well, the annulus having a first section formed between the conduit and the wellbore wall and a second section formed between the tubing and the wellbore wall;

receiving a gas flow from the second section of the annulus in a flow control device; and conveying a well liquid from the deviated leg of the well via the fluid conduit to the fluid mover in the substantially vertical leg of the well by controlling a flow of gas out of the annulus of the well using the flow control device and increasing a pressure applied to the liquid in the conduit by controlling a rate of gas flowing out of the well, wherein the gas in the annulus, a liquid in the annulus, and the liquid in the conduit are in pressure communication with one another.

10. The method of claim 9, wherein the flow of gas is controlled using pressure information from the well.

11. The method of claim 10, further comprising measuring pressure from at least two locations in the well to obtain the pressure information.

12. The method of claim 10, wherein the pressure information includes a pressure differential in the well.

13. The method of claim 9, further comprising maintaining a liquid contact between the fluid and the fluid mover by controlling the rate of gas flowing out of the well.

14. The method of claim 13, further comprising generating at least a predetermined net suction pressure head at the fluid mover.

15. The method of claim 13, further comprising controlling at least one operating parameter relating to the flow control device.

16. The method of claim 9, further comprising operating the fluid mover to remove a liquid produced from a formation to at least one of: (i) control a reservoir pressure, and (ii) achieve a desired production flow rate of a gas produced from the formation.

* * * * *